US007494031B2

(12) United States Patent
Kassai et al.

(10) Patent No.: US 7,494,031 B2
(45) Date of Patent: Feb. 24, 2009

(54) NURSERY BAND

(75) Inventors: Kenzou Kassai, Osaka (JP); Miyuki Nishikura, Kobe (JP)

(73) Assignee: Graco Children's Products Inc., Exton, PA (US)

( * ) Notice: Subject to any disclaimer, the term of this patent is extended or adjusted under 35 U.S.C. 154(b) by 345 days.

(21) Appl. No.: 11/134,853

(22) Filed: May 20, 2005

(65) Prior Publication Data

US 2006/0011678 A1 Jan. 19, 2006

(30) Foreign Application Priority Data

Jul. 12, 2004 (JP) ..... 2004-204922

(51) Int. Cl.
*A61G 1/00* (2006.01)

(52) U.S. Cl. ..... 224/160; 224/159

(58) Field of Classification Search ..... 224/158, 224/159, 160

See application file for complete search history.

(56) References Cited

U.S. PATENT DOCUMENTS

| | | | | |
|---|---|---|---|---|
| 5,490,620 | A * | 2/1996 | Bergqvist | 224/160 |
| 6,045,018 | A * | 4/2000 | Onishi | 224/158 |
| 6,257,468 | B1 * | 7/2001 | Yamazoe et al. | 224/158 |
| 2001/0030210 | A1 * | 10/2001 | Donine | 224/160 |
| 2002/0158094 | A1 | 10/2002 | Yen | |
| 2003/0178452 | A1 | 9/2003 | Norman | |
| 2005/0189386 | A1 * | 9/2005 | Mortell | 224/160 |

FOREIGN PATENT DOCUMENTS

| | | | |
|---|---|---|---|
| EP | 0611234 | * | 8/1994 |
| EP | 0734671 | * | 3/1996 |
| EP | 1591044 | | 11/2005 |
| JP | 2000245581 | | 9/2000 |
| JP | 2003000401 | | 1/2003 |

OTHER PUBLICATIONS

Search Report, 05 011 951.0-1258, Jul. 18, 2006.
Search Report.

* cited by examiner

*Primary Examiner*—Tri M Mai
(74) *Attorney, Agent, or Firm*—Ditthavong Mori & Steiner, P.C.

(57) ABSTRACT

A nursery band includes a back pad for supporting a back of a baby or infant, a head supporter for supporting a head of the baby or infant, located above the back pad, a pair of sideways protrusions protruding sideways from both sides of the head supporter, a pair of side forming members extending in a vertical direction continuously to both of side edges of the back pad, and a connecting part for detachably connecting a tip of each of the pair of sideways protrusions to each of the pair of side forming members. The head supporter is disposed in such a manner as to be freely folded over at a back surface of the back pad in a state where the connection via the connecting parts is maintained. Thus, there is provided a nursery band capable of varying the manner with the reduced number of component parts.

4 Claims, 14 Drawing Sheets

NURSERY BAND

BACKGROUND OF THE INVENTION

1. Field of the Invention

The invention relates to a nursery band and, more particularly, to a nursery band applicable to both states where a baby or infant is held in a lateral manner and a vertical manner.

2. Description of the Related Art

It is preferable that a nursery band, which is used at the time when a person walks while holding a baby or infant in his/her arms or on his/her back, should be used in various manners according to the growth level of the baby or infant. In other words, it is preferable that a baby should be held in a lateral manner during babyhood before the head of the baby is set. In contrast, it is preferable that an infant should be held in a pickaback ride or a vertical manner when the head of the infant is set and the body of the infant becomes bigger.

When a baby is held in the lateral manner, it is undesirable from the viewpoint of safety that the head of the baby is exposed. Therefore, a nursery band applicable to the laterally holding manner is normally provided with a shield for covering the head of the baby. In contrast, the above-described shield becomes obstructive in a nursery band applicable to the pickaback ride or the vertically holding manner.

There have been already proposed some nursery bands applicable to both of the laterally holding manner and the vertically holding manner, as described above.

Japanese Unexamined Patent Publication No. JP-A 2003-401 discloses a baby carrier (i.e., a nursery band) with a pad, which can provide safety and comfort according to various holding manners such as a laterally holding manner, a pickaback ride and a vertically holding manner. The baby carrier (i.e., the nursery band) disclosed in Japanese Unexamined Patent Publication No. JP-A 2003-401 is equipped with two kinds of pads independently of a carrier body (i.e., the nursery band), wherein the two kinds of pads are used according to the growth level of a baby. Specifically, a pad having a shield-like guard for covering the head of a baby is used during babyhood when the head of the baby has not been set yet. In contrast, a pad without any guard is used when the head of an infant is set and the body of the infant becomes bigger.

Japanese Unexamined Patent Publication No. JP-A 2000-245581 discloses a nursery band which can be used with respect to not only a baby but also an infant as a child grows. The nursery band disclosed in Japanese Unexamined Patent Publication No. JP-A 2000-245581 has a baby head keeper having a rising side surface for surrounding a head of a baby or infant head supporter without any rising side surface independently of a nursery band body, wherein these two kinds of component parts are used according to the growth level of a baby or infant. Specifically, when a small baby is held in a lateral manner, the baby head keeper having the rising side surface is attached to the nursery band body. In contrast, when a relatively big infant is held in a vertical manner, the baby head keeper is detached, and in turn, the infant head supporter is attached to the nursery band body.

In both of the nursery bands disclosed in both of Japanese Unexamined Patent Publication No. JP-A 2003-401 and Japanese Unexamined Patent Publication No. JP-A 2000-245581, the two kinds of component parts are prepared independently of the nursery band body, and thus, they are used according to the growth level of the baby or infant.

However, the number of component parts should be preferably small from the viewpoint of user friendliness or a cost.

SUMMARY OF THE INVENTION

Therefore, an object of the invention is to provide a nursery band capable of varying a manner with the reduced number of component parts.

A nursery band according to the invention includes a back pad for supporting a back of a baby or infant, a head supporter for supporting a head of the baby or infant, located above the back pad, a pair of sideways protrusions protruding sideways from both sides of the head supporter, a pair of side forming members extending in a vertical direction continuously to both of side edges of the back pad, and a connecting part for detachably connecting a tip of each of the pair of sideways protrusions to each of the pair of side forming members. The head supporter is disposed in such a manner as to be freely folded over at a back surface of the back pad in a state where the connection via the connecting part is maintained.

With the above-described configuration, when the head supporter is folded over, a region positioned above the back pad is released, so that the existence of the head supporter never interferes with a baby or infant in the case where a big baby or infant is held in a vertical manner or in a pickaback ride.

Preferably, the connecting part includes an adjusting belt for connecting the sideways protrusion to the side forming member in such a manner that its length can be freely adjusted. The head supporter extends in approximately the same direction as that of the back pad when the adjusting belt is relatively long. In contrast, the head supporter is erected with respect to the back pad when the adjusting belt is relatively short. In the case of a small baby, preferably, the head supporter is erected with respect to the back pad, so that the baby is held in a lateral manner. In contrast, when the baby becomes bigger, preferably, the head supporter extends in approximately the same direction as that of the back pad, so that the baby or infant is held in a vertical manner or in a pickaback ride.

Preferably, the back pad includes a back surface cover defining a bag-like portion on a back surface side, and a back pad plate disposed in a manner freely putting in/putting out under the back surface cover. An upper portion of the back pad can be folded over in such a manner as to be superimposed on a back surface at a lower portion of the back pad together with the head supporter in the state where the back pad plate is detached. If the back pad is folded over in the above-described manner, the upper portion of the back pad is largely released, so that the nursery band is suitable for the case where, for example, the baby or infant is held in the vertical manner while he/she faces forward. In order to conveniently fold over the back pad, preferably, the back pad includes a first pad extending in a width direction above the back pad, and a second pad extending in a width direction adjacently under the first pad. The first pad can be folded over in such a manner as to be superimposed on the back surface of the second pad together with the head supporter.

In a preferred embodiment, a nursery band includes a first belt member and a second belt member secured onto the pair of side forming members, respectively, and extending in a vertical direction. The first belt member and the second belt member cross each other on a crotch pad for supporting a crotch of a baby or infant. Connecting tools, which are fitted to each other, are disposed at both of one end of the first belt member and the other end of the second belt, respectively. In contrast, connecting tools, which are fitted to each other, are disposed at both of the other end of the first belt member and one end of the second belt, respectively.

DESCRIPTION OF THE PREFERRED EMBODIMENTS

Figure 1:
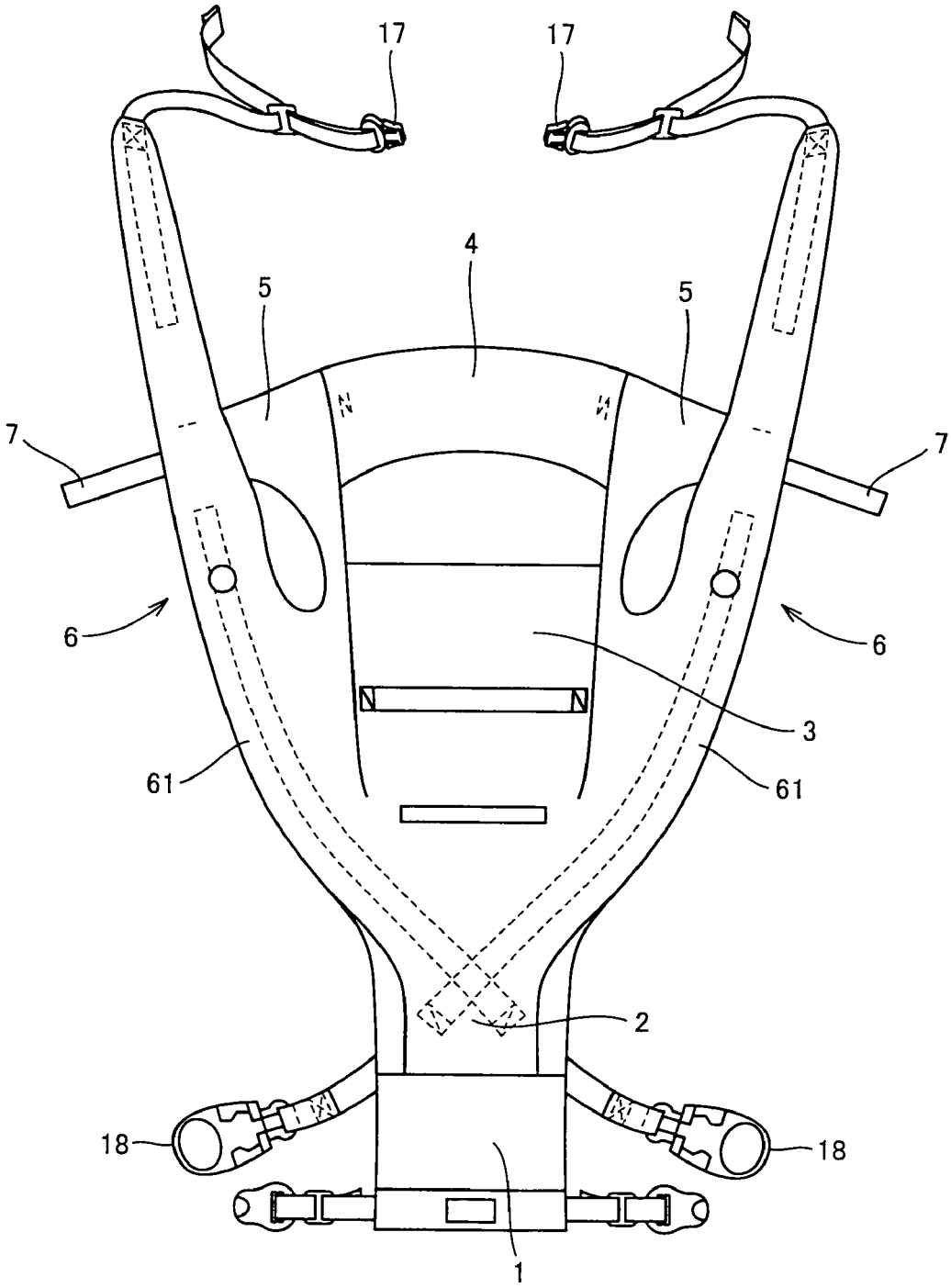
FIG. 1 is a developed view showing an inside of a nursery band.
Figure 2:
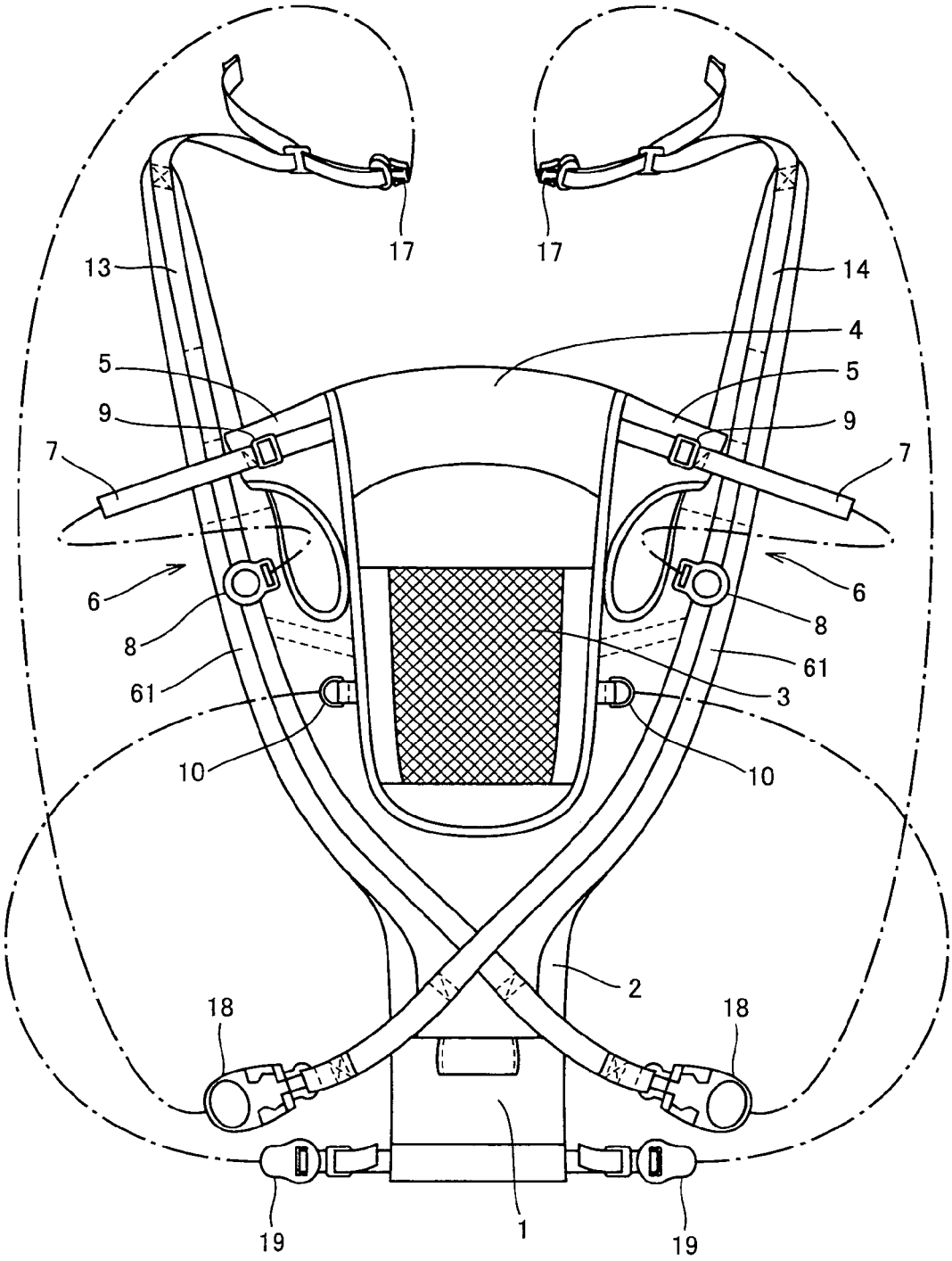
FIG. 2 is a developed view showing an outside of the nursery band.
Figure 3:
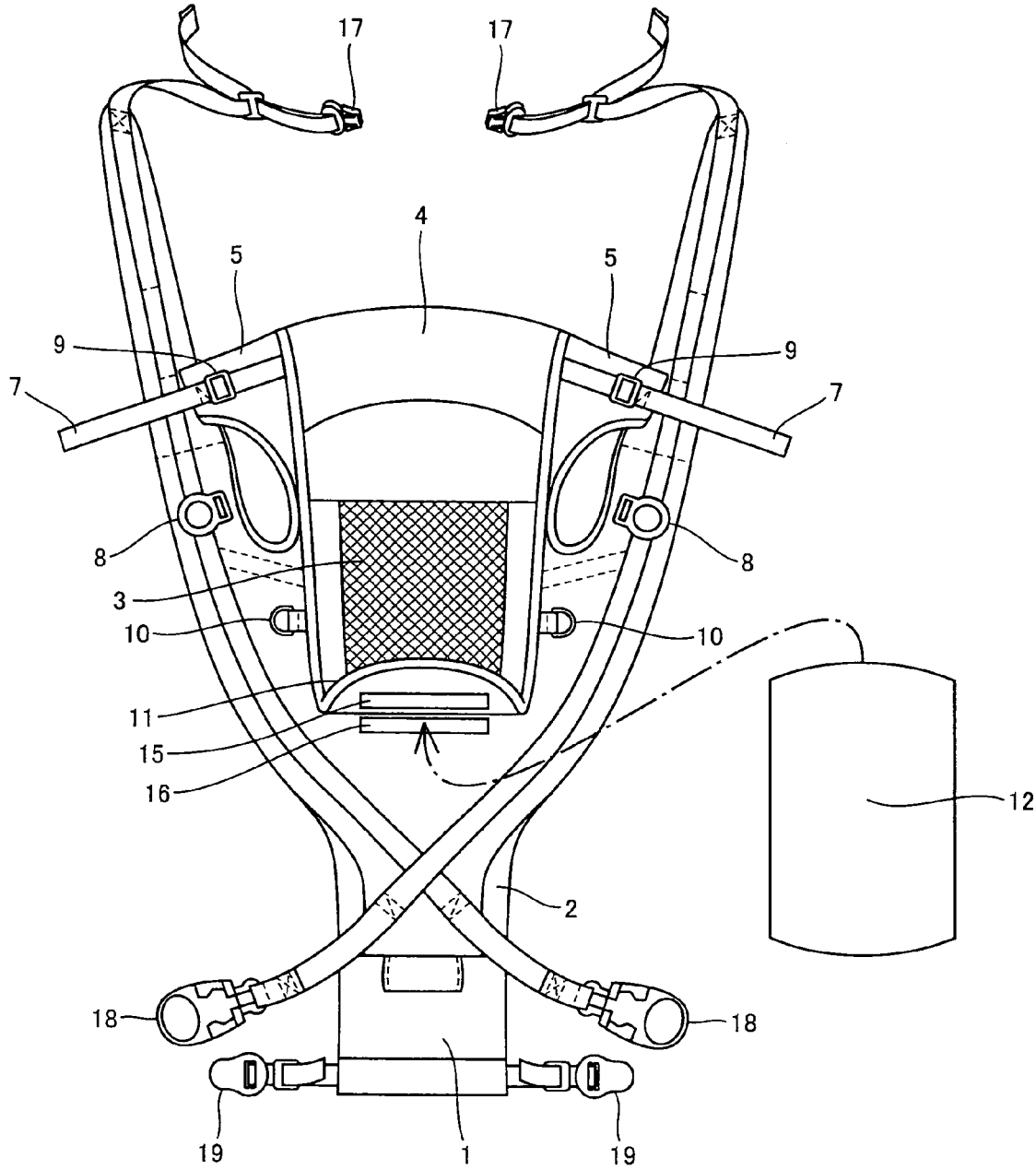
FIG. 3 is a developed view showing the nursery band in the state where a back pad is detached.

FIGS. 1 and 2 are developed views showing a nursery band according to a preferred embodiment of the invention. FIG. 1 shows an inside of the nursery band and FIG. 2 shows an outside of the nursery band. FIG. 3 shows a state where a back pad plate 12 is detached.

Figure 4:
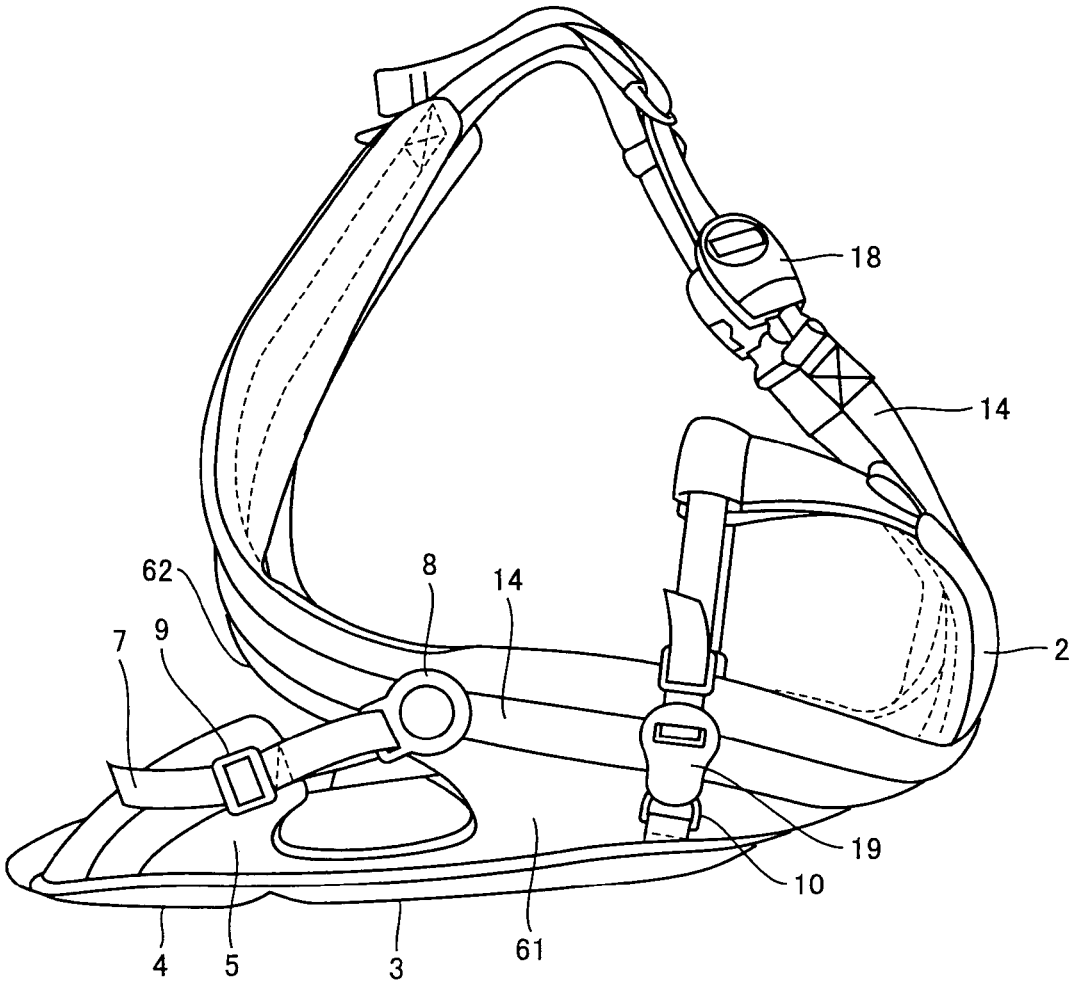
FIG. 4 is a view showing one use manner of the nursery band in the state where a head supporter extends in approximately the same direction as that of the back pad.
Figure 5:
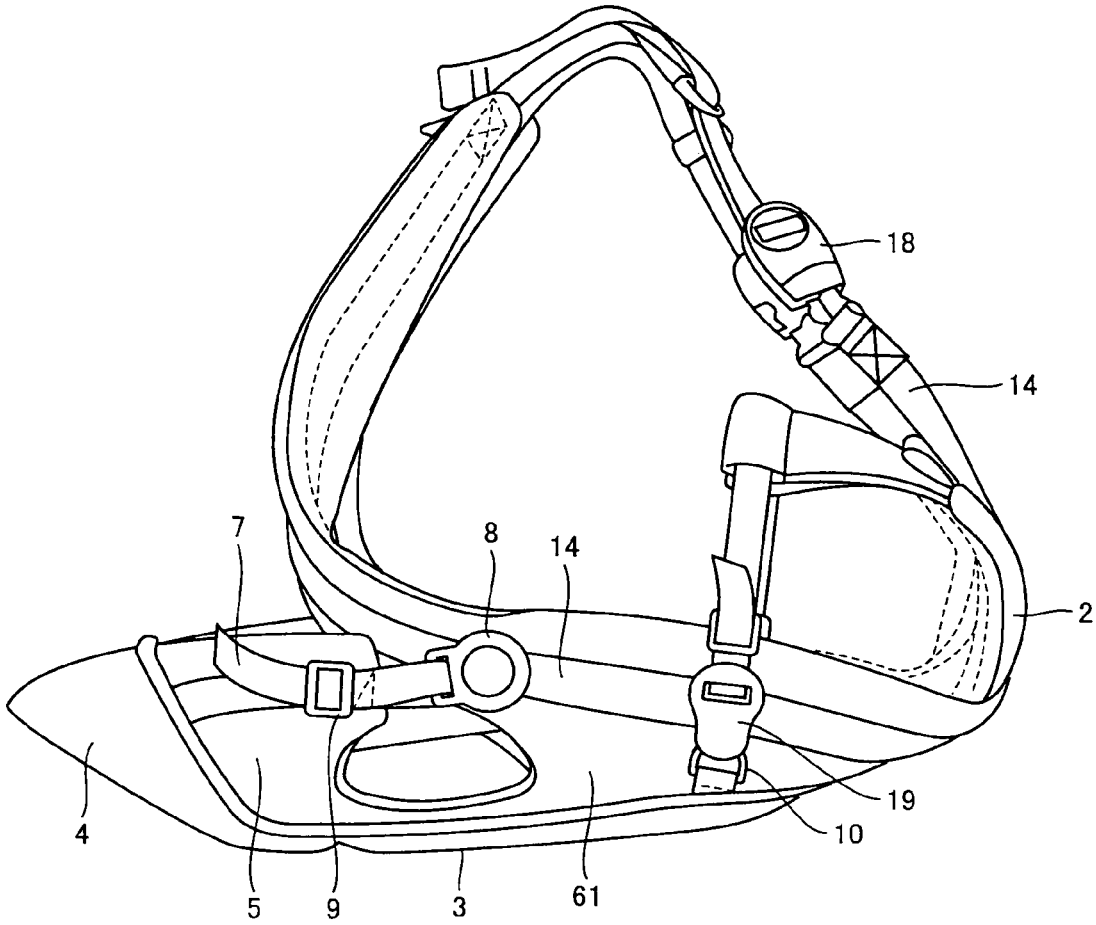
FIG. 5 is a view showing another use manner of the nursery band in the state where the head supporter is erected with respect to the back pad.
Figure 6:
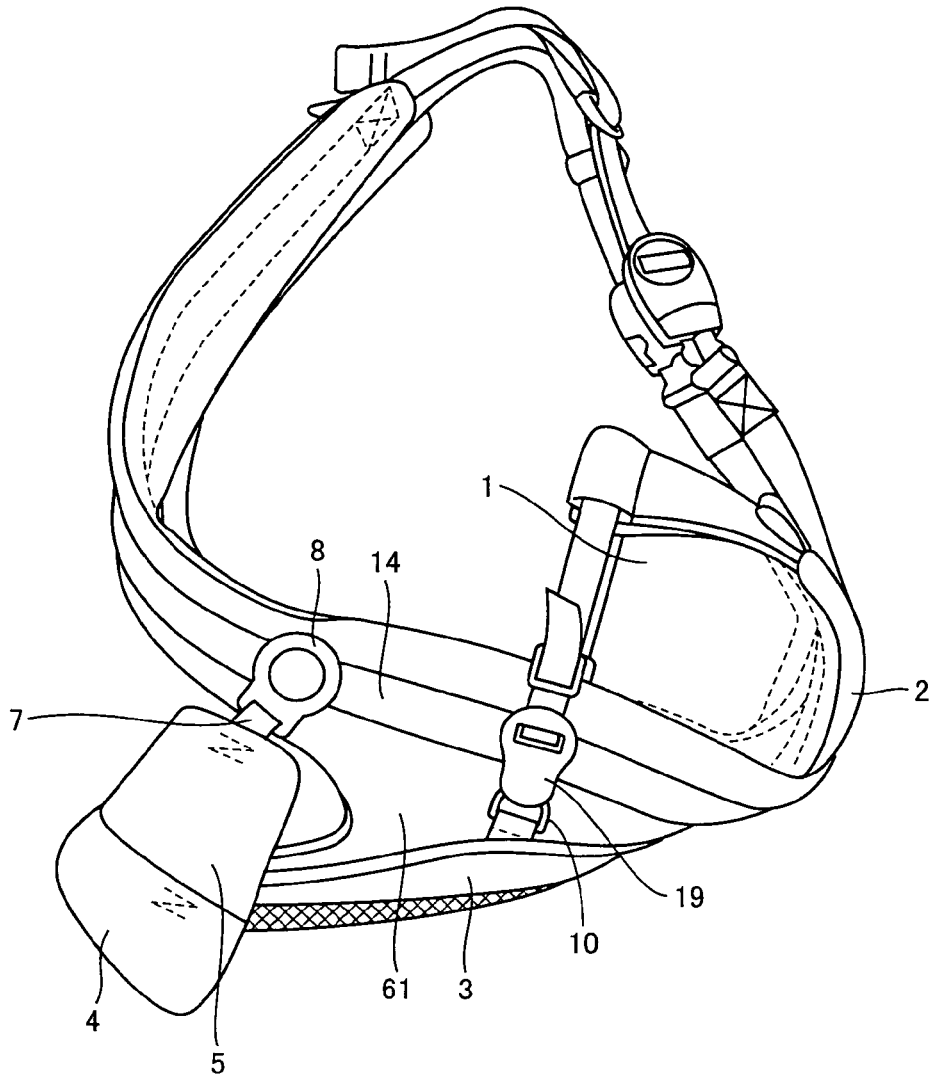
FIG. 6 is a view showing still another use manner of the nursery band in the state where the head supporter is folded over on a back surface side of the back pad.
Figure 7:
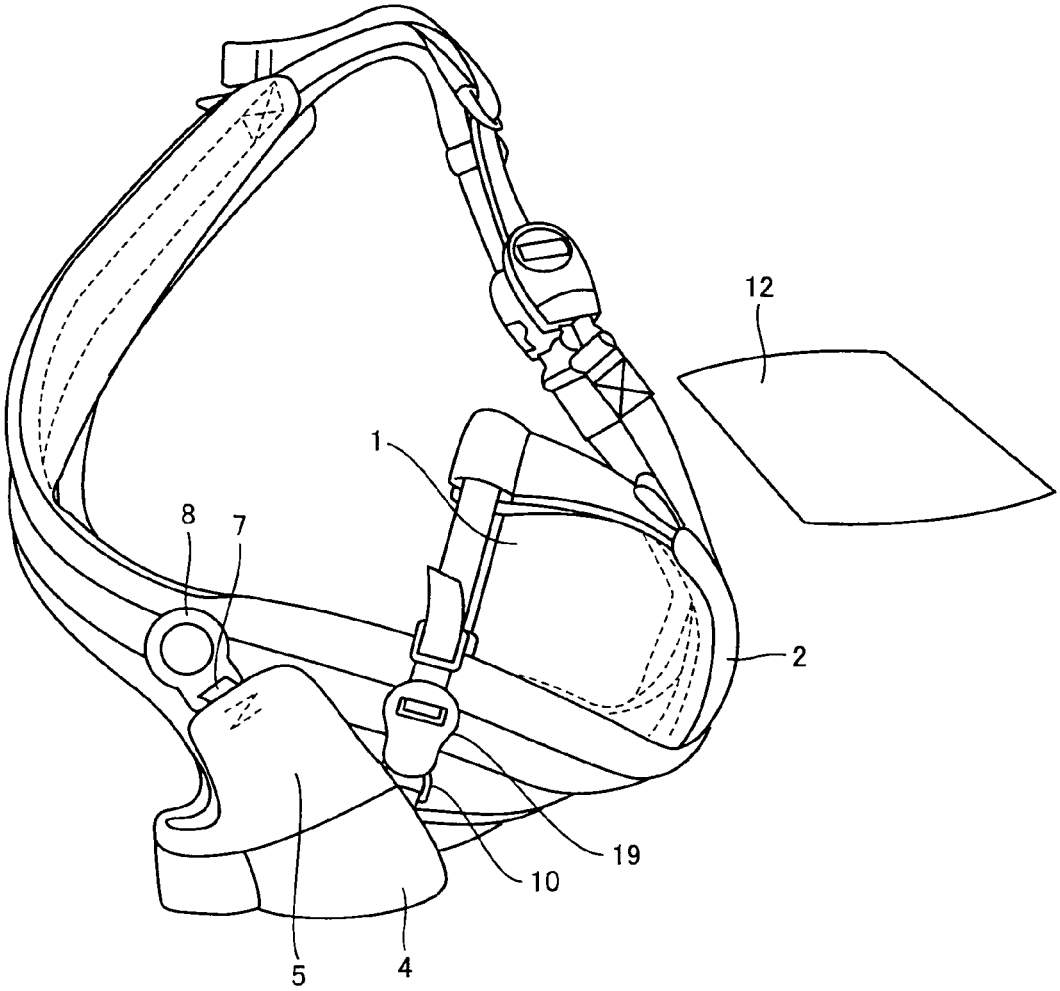
FIG. 7 is a view showing yet another use manner of the nursery band in the state where an upper portion of the back pad is folded over together with the head supporter.

FIG. 4 shows one use manner in the state where a head supporter 4 extends in approximately the same direction as that of a back pad 3. FIG. 5 shows another use manner in the state where the head supporter 4 is erected with respect to the back pad 3. FIG. 6 shows a state where the head supporter 4 is folded over on a back surface side of the back pad 3. FIG. 7 shows a state where upper portions of the head supporter 4 and the back pad 3 are folded over.

Figure 8:
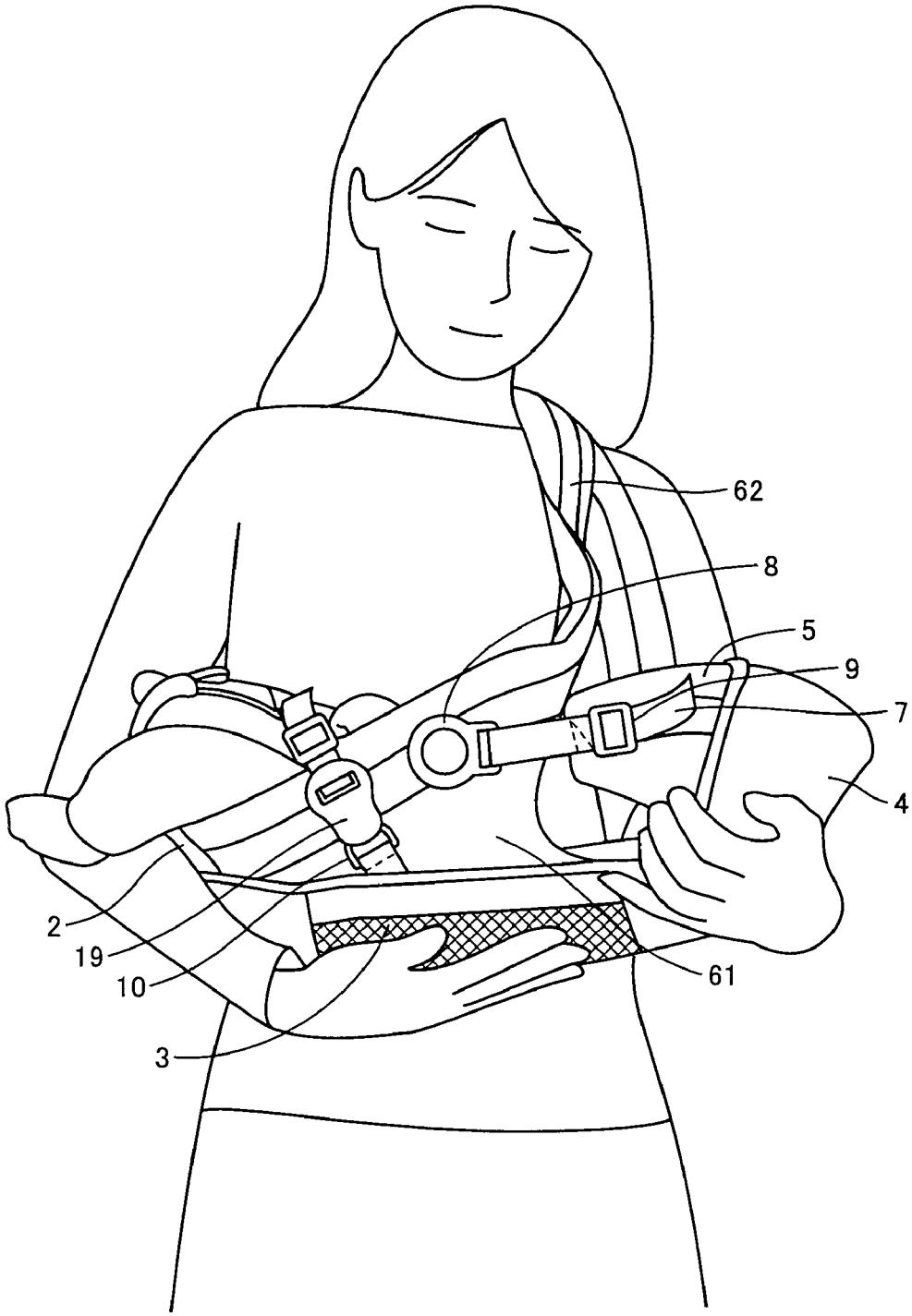
FIG. 8 illustrates a laterally holding manner.
Figure 9:
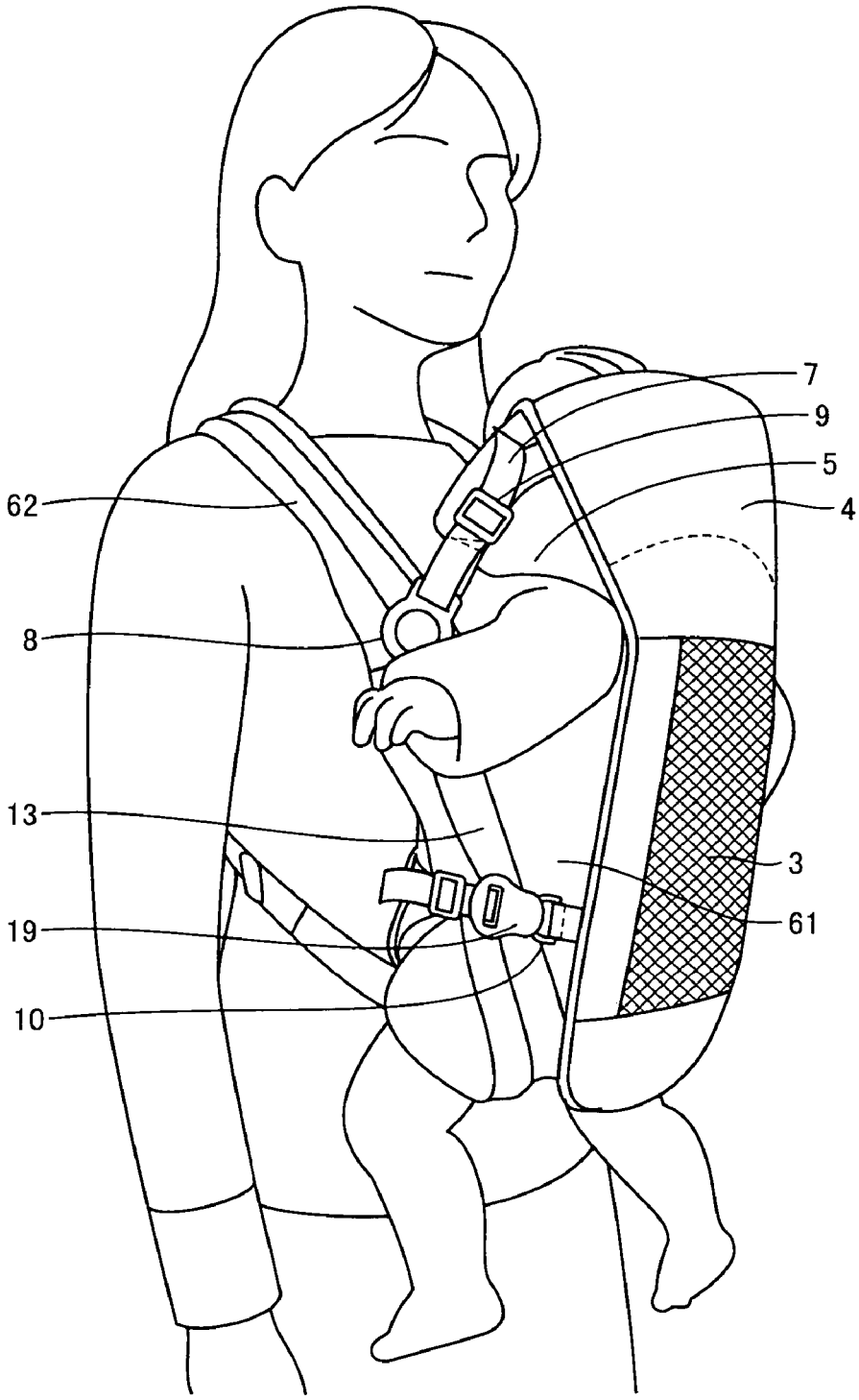
FIG. 9 illustrates a vertically holding and face-to-face manner.
Figure 10:
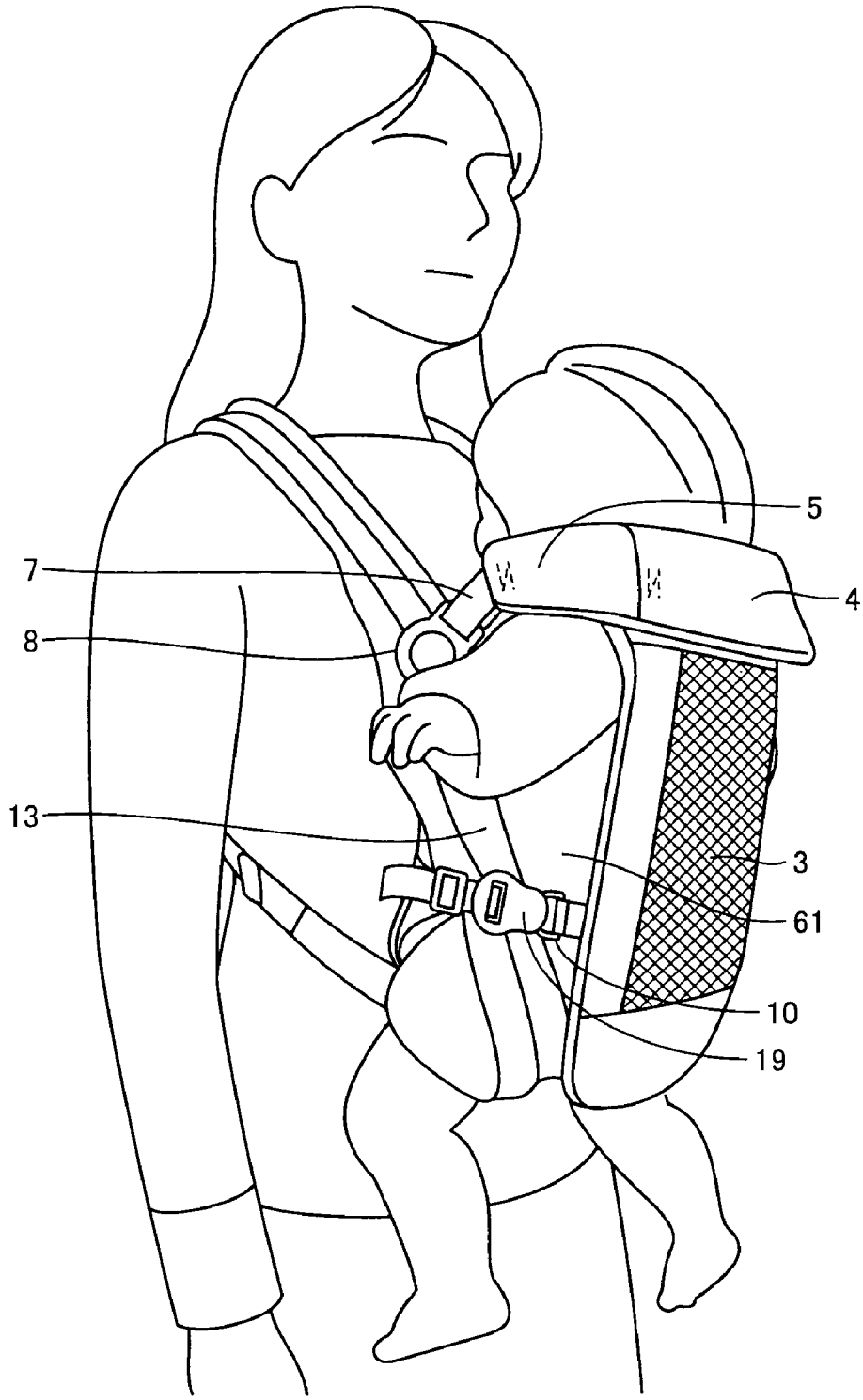
FIG. 10 illustrates the vertically holding and face-to-face manner in the state where the head supporter is folded over.
Figure 11:
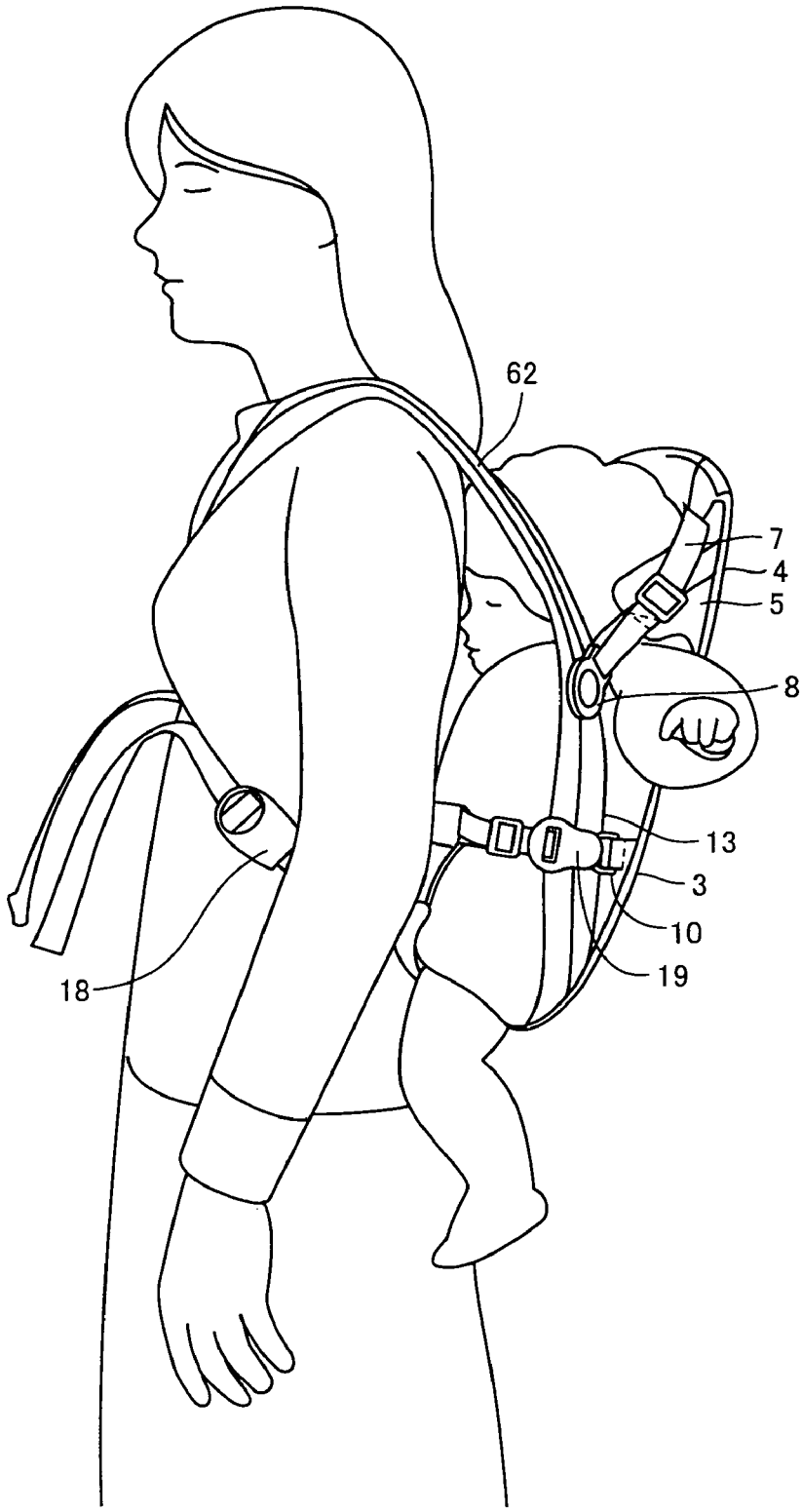
FIG. 11 illustrates a pickaback ride.
Figure 12:
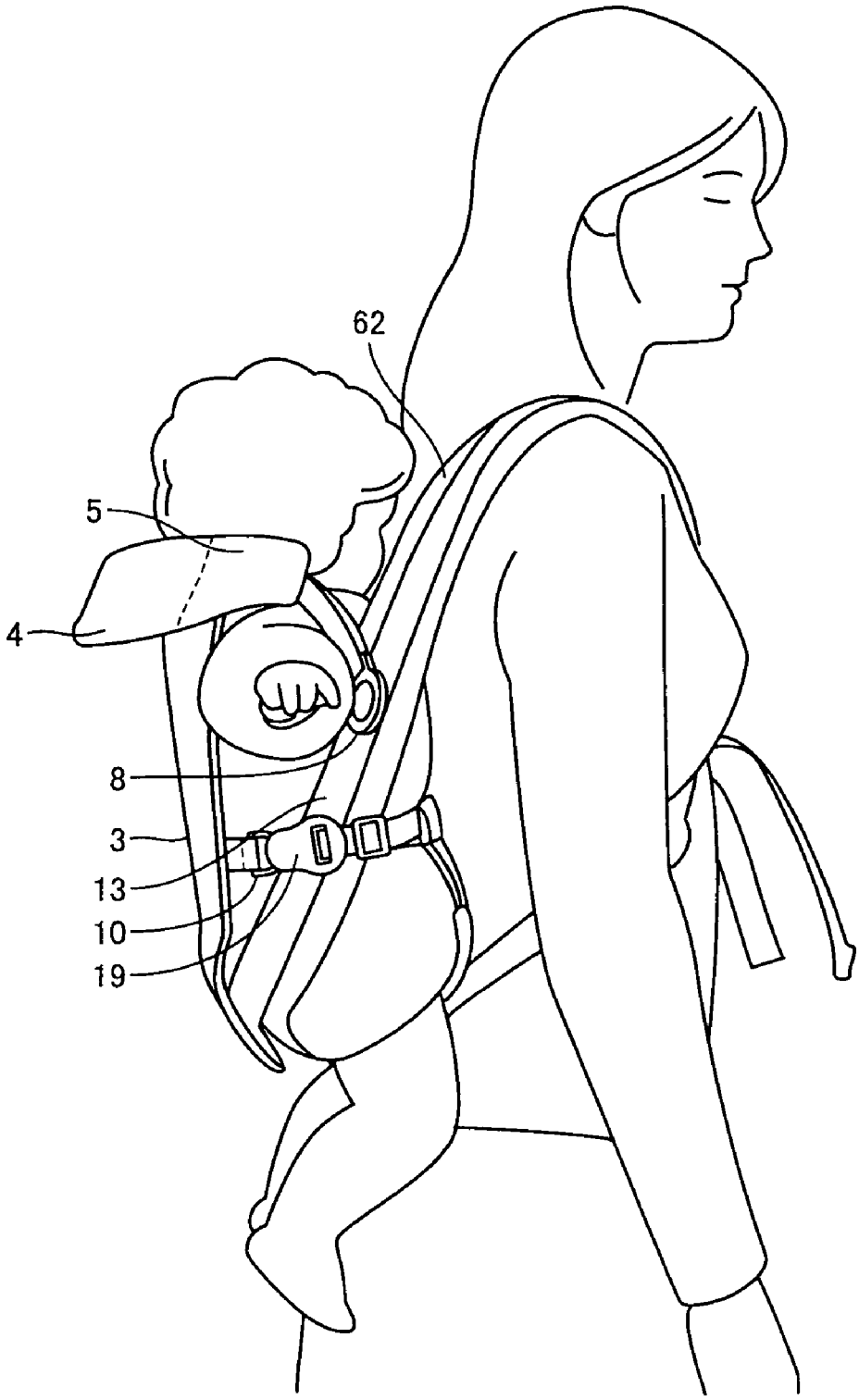
FIG. 12 illustrates the pickaback ride in the state where the head supporter is folded over.
Figure 13:
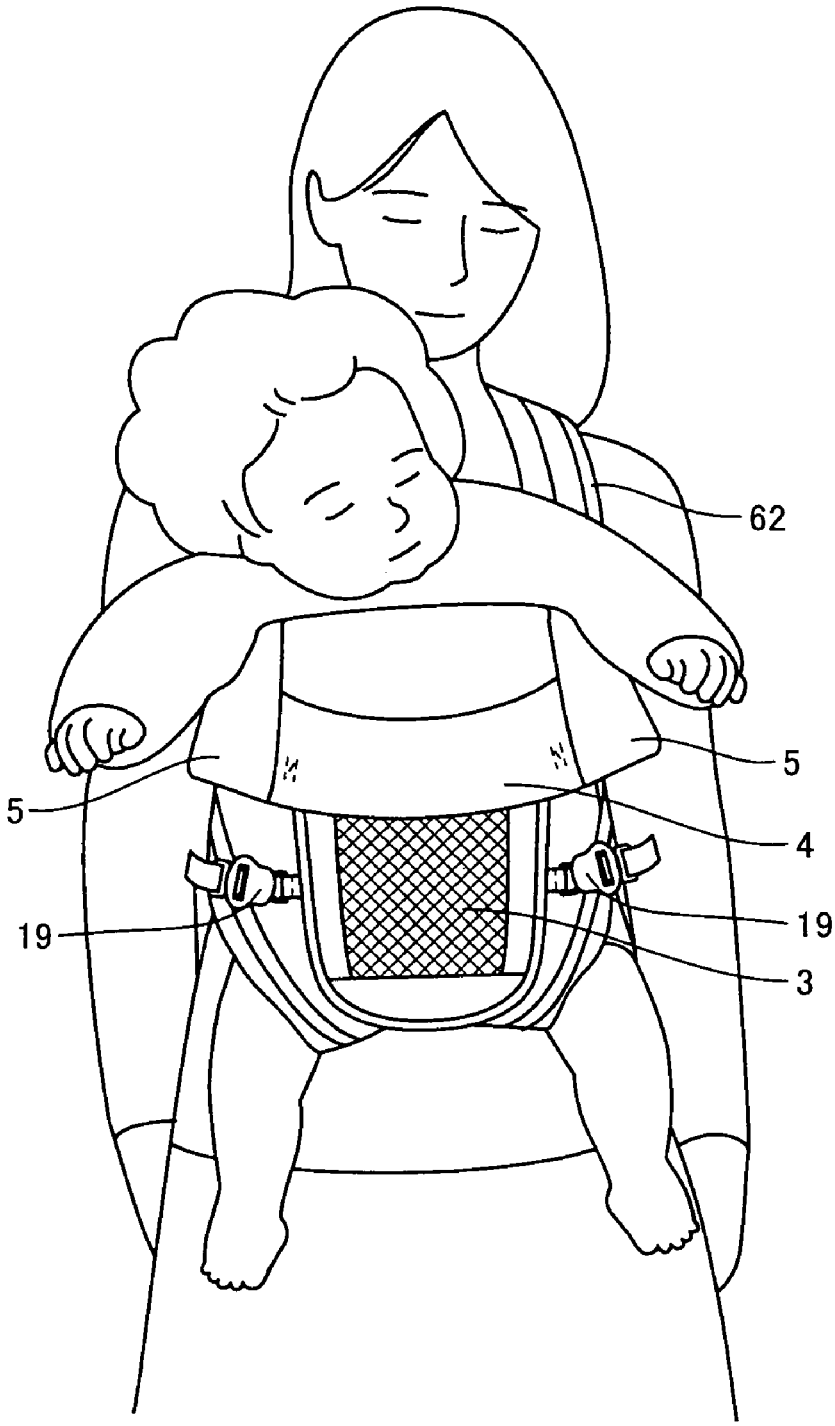
FIG. 13 illustrates the vertically holding manner in the state where a baby or infant faces forward.

FIGS. 8 to 13 show various manners in which a baby or infant is held. FIG. 8 shows a laterally holding manner. FIG. 9 shows a vertically holding and face-to-face manner in the state where a mother faces a baby or infant. FIG. 10 shows a state where the head supporter 4 is folded over from the state shown in FIG. 9. FIG. 11 shows a pickaback ride. FIG. 12 shows a state where the head supporter 4 is folded over from the state shown in FIG. 11. FIG. 13 shows the vertically holding manner in the state where the baby or infant faces forward.

Description will be given below of the configuration of the nursery band with reference to mainly FIGS. 1 and 2.

The nursery band in the preferred embodiment shown in the figures is basically formed from a single member integrated in a unit, so as to achieve various baby or infant holding manners. Specifically, the nursery band includes a front pad 1 for supporting a stomach of a baby or infant, a crotch pad 2 for supporting a crotch of the baby or infant continuously to the front pad 1, the back pad 3 for supporting a back of the baby or infant continuously to the crotch pad 2, the head supporter 4 for supporting a head of the baby or infant continuously to the back pad 3, a pair of sideways protrusions 5 protruding sideways from both sides of the head supporter 4, a pair of side forming members 6 extending in a vertical direction continuously to both of side edges of the back pad 3, and a connecting part for detachably connecting a tip of each of the pair of sideways protrusions 5 to each of the pair of side forming members 6.

Each of the side forming members 6 includes a side wall forming portion 61, which is positioned sideways of the back pad 3 so as to support the side portion of the baby or infant, and a shoulder band portion 62 extending upward from an upper end of the back pad 3.

The nursery band includes a first belt member 13 and a second belt member 14, which are secured onto the pair of side forming members 6, respectively, and extend in a vertical direction. The first belt member 13 and the second belt member 14 cross each other on the crotch pad 2. The first belt member 13 and the second belt member 14 greatly extend at their upper and lower ends beyond the shoulder band portion 62 and the crotch pad 2, and further, they have connecting tools at both ends thereof. In the preferred embodiment shown in the figures, the first belt member 13 has a connecting/inserting tool 17 at the upper end thereof. In the meantime, the second belt member 14 has, at the lower end thereof, a connecting/receiving tool 18 to be fitted to the connecting/inserting tool 17 of the first belt member 13. In the same manner, the second belt member 14 has a connecting/inserting tool 17 at the upper end thereof. In the meantime, the first belt member 13 has, at the lower end thereof, a connecting/receiving tool 18 to be fitted to the connecting/inserting tool 17 of the second belt member 14.

The connecting part for detachably connecting a tip of each of the pair of sideways protrusions 5 to each of the pair of side forming members 6 includes adjusting belts 7 extensively projecting from the tip of each of the pair of sideways protrusions 5, and connecting tools 8 disposed on the pair of belt members 13 and 14, respectively, for allowing the adjusting belts 7 to be inserted therethrough.

In the preferred embodiment shown in the figures, each of the connecting tools 8 is exposed onto the back surface of the nursery band, and further, has a belt inserting hole, into which the adjusting belt 7 is inserted. The connecting tool 8 may be configured such that its obverse and reverse are freely reversed.

As is clear from FIGS. 2 and 3, to the adjusting belt 7 is attached a length adjusting tool 9. The tip of the adjusting belt 7 passes through the belt inserting hole formed at the connecting tool 8, and thereafter, passes through the length adjusting tool 9. The length of the adjusting belt 7 can be freely varied by adjusting the length of the tip passing through the length adjusting tool 9.

As shown in FIGS. 2 and 3, rings 10 are secured onto both sides of the back surface of the back pad 3. Hooks 19 detachably engageable with the rings 10, respectively, are attached onto both sides of the tip of the front pad 1 in a manner corresponding to the rings 10.

As shown in FIG. 3, the back pad 3 includes a back surface cover 11 defining a bag-like portion on the back surface side, and the back pad plate 12 disposed under the back surface cover 11 in such a manner as to be freely put in/put out of the back surface cover 11. FIGS. 1 and 2 show a state where the back pad plate 12 is attached. In contrast, FIG. 3 show a state where the back pad plate 12 is detached. The tip of the back surface cover 11 is designed such that its opening is closed by surface fasteners 15 and 16 to be fastened to each other. In the state where the back pad plate 12 is contained under the back surface cover 11, the back pad 3 is improved in rigidity. In contrast, in the state where the back pad plate 12 is detached, the upper portion of the back pad 3 can be folded over onto the back surface.

Incidentally, the head supporter 4 and the pair of sideways protrusions 5 have therein a member having a relative rigidity such as a pad, and therefore, they exhibit a given shape keeping property. The head supporter 4 can be bent with respect to the back pad 3. Moreover, the pair of sideways protrusions 5 can be bent with respect to the head supporter 4.

Figure 14:
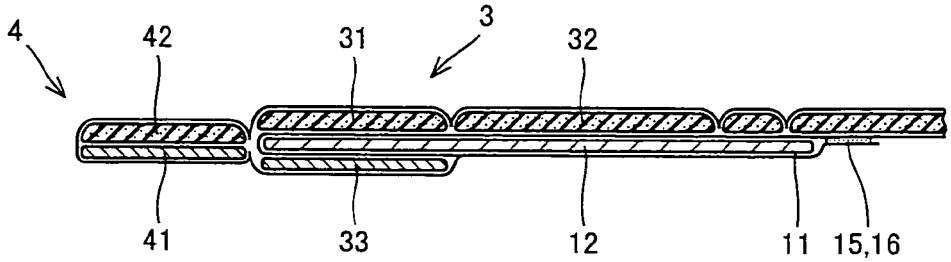
FIG. 14 is a cross-sectional view showing one example of a structure of the head supporter and the back pad.
Figure 15:
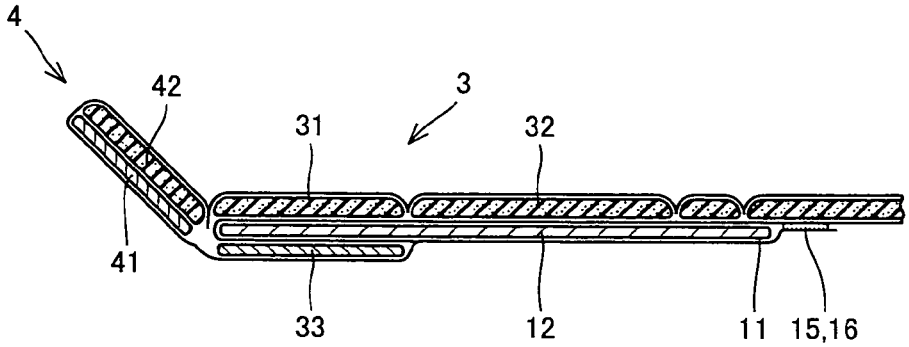
FIG. 15 is a cross-sectional view showing the head supporter in an erected state.
Figure 16:
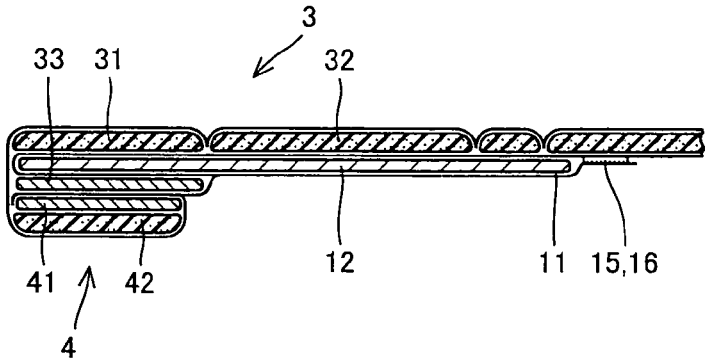
FIG. 16 is a cross-sectional view showing the head supporter folded over in such a manner as to be superimposed on the back surface of the back pad.
Figure 17:
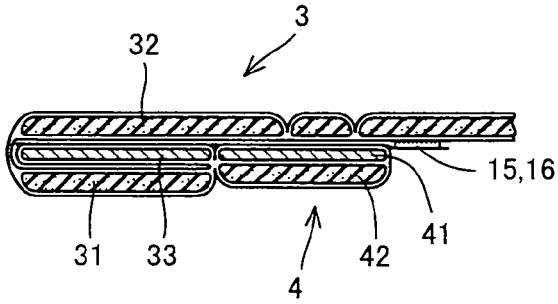
FIG. 17 is a cross-sectional view showing upper regions of the head supporter and the back pad folded over in such a manner as to be superimposed on a back surface in a lower region of the back pad.

FIG. 14 is a cross-sectional view showing one example of structures of the head supporter 4 and the back pad 3. FIGS. 15 to 17 show various manners of the head supporter 4 and the back pad 3. As shown in FIGS. 14 to 17, the head supporter 4 is provided with a head supporter core member 41 and a head supporter pad 42 mounted on the head supporter core member 41. In the meantime, the back pad 3 is provided with an upper back pad core member 33 extending in a width direction in the upper region thereof, a first pad 31 mounted on the upper back pad core member 33, and a second pad 32, which is disposed adjacently under the first pad 31 and extends in the width direction. The back pad plate 12 is located behind the first pad 31 and the second pad 32, and further, the upper portion of the back pad plate 12 is interposed between the first pad 31 and the upper back pad core member 33.

A manner shown in FIG. 15 is achieved by adjusting the length of the adjusting belt 7. That is, if the length of the adjusting belt 7 is reduced, the head supporter 4 is erected from an upper edge of the back pad 3.

In a manner shown in FIG. 16, the head supporter 4 is folded over on the back surface of the back pad 3. In a manner shown in FIG. 17, the back pad plate 12 is detached, and further, a back pad upper region including the upper back pad core member 33 and the first pad 31 is folded over in such a manner as to be superimposed in a lower region of the back pad 3 together with the head supporter 4.

Here, the back pad plate 12 is not detached but shifted downward, so that the back pad upper region may be folded over in the lower region of the back pad 3 together with the head supporter. Alternatively, no back pad plate 12 may be provided since the first pad 31, the second pad 32 and the upper back pad core member 33 exhibit the shape keeping property on a certain level.

Subsequently, description will be made below on various use manners of the nursery band.

FIG. 4 shows a state where the adjusting belt 7 extending from each of the pair of sideways protrusions 5 is increased in length. The hook 19 attached to the front pad 1 engages with the ring 10. In the state shown in FIG. 4, the head supporter 4 extends in approximately the same direction as that of the back pad 3. The use manner shown in FIG. 4 is adopted when a baby or infant is held in the vertical and face-to-face manner as shown in FIG. 9 or in the pickaback ride as shown in FIG. 11.

FIG. 5 shows a state where the adjusting belt 7 extending from the tip of each of the pair of sideways protrusions 5 is reduced in length. In this state, the head supporter 4 is erected with respect to the back pad 3. When a baby or infant is held in the lateral manner as shown in FIG. 8, the use manner shown in FIG. 5 is adopted. This use manner is preferable from the viewpoint of the safety since the erected head supporter 4 and the pair of sideways protrusions 5 surround around the head of a baby or infant.

FIG. 6 shows a state where the head supporter 4 is folded over in such a manner as to be superimposed on the back surface of the back pad 3 while the adjusting belt 7 and the connecting tool 8 are kept to be connected to each other. The use manner shown in FIG. 6 is adopted when a big baby or big infant is held in the vertical and face-to-face manner as shown in FIG. 10 or in the pickaback ride as shown in FIG. 12. The existence of the head supporter 4 never interferes with a baby or infant since the region located above the back pad 3 is released by folding the head supporter 4.

FIG. 7 shows a state where the back pad plate 12 is detached and the upper portion of the back pad 3 is folded over in such a manner as to be superimposed on the back surface of the lower portion of the back pad 3 together with the head supporter 4 while the adjusting belt 7 and the connecting tool 8 are kept to be connected to each other. The use manner shown in FIG. 7 is adopted when a baby or infant is held in the vertical manner while he/she faces forward, as shown in FIG. 13. Therefore, a good front visibility can be provided for the baby or infant.

Although the description has been given above of the preferred embodiment of the invention with reference to the attached drawings, it is to be understood that the invention should not be limited to the above-described preferred embodiment. In addition to the preferred embodiment shown in the attached drawings, it is needless to say that various modifications and alterations can be implemented within the same scope of the invention or within an equivalent scope of the invention.

Thus, the invention can be used in the nursery band applicable to both states where a baby or infant is held in the lateral manner and the vertical manner.

What is claimed is:

1. A nursery band comprising:

a back pad for supporting a back of a baby or infant;

a head supporter for supporting a head of the baby or infant, located above said back pad;

a pair of sideways protrusions protruding sideways from both sides of said head supporter;

a pair of side forming members extending in a vertical direction continuously to both of side edges of said back pad; and connecting means for detachably connecting a tip of each of said pair of sideways protrusions to each of said pair of side forming members, wherein said head supporter is disposed in such a manner as to be freely folded over at a back surface of said back pad in a state where the connection via said connecting means is maintained, said back pad includes a back surface cover defining a bag-like portion on a back surface side, and a back pad plate disposed in a manner freely putting in/putting out under said back surface cover, and an upper portion of said back pad can be folded over in such a manner as to be superimposed on a back surface at a lower portion of said back pad together with said head supporter in the state where said back pad plate is detached.

2. The nursery band according to claim 1, wherein said connecting means includes an adjusting belt for connecting said sideways protrusion to said side forming member in such a manner that its length can be freely adjusted, and said head supporter extends in approximately the same direction as that of said back pad when said adjusting belt is relatively long, while said head supporter is erected with respect to said back pad when said adjusting belt is relatively short.

3. The nursery band according to claim 1, wherein said back pad includes a first pad extending in a direction above the back pad, and a second pad extending in a width direction adjacently under said first pad, and said first pad can be folded over in such a manner as to be superimposed on the back surface of said second pad together with said head supporter.

4. The nursery band according to claim 1, further comprising:

a first belt member and a second belt member secured onto said pair of side forming members, respectively, and extending in a vertical direction, wherein said first belt member and said second belt member cross each other on a crotch pad for supporting a crotch of a baby or infant, and connecting tools, which are fitted to each other, are disposed at both of one end of said first belt member and the other end of said second belt, respectively, while connecting tools, which are fitted to each other, are disposed at both of the other end of said first belt member and one end of said second belt, respectively.

* * * * *